US009145899B2

(12) United States Patent
Yokozawa et al.

(10) Patent No.: US 9,145,899 B2
(45) Date of Patent: Sep. 29, 2015

(54) PUMP DEVICE WITH TURNING PREVENTION PROTRUDED PART TO PREVENT TURNING OF A FIRST CASE RELATIVE TO A SECOND CASE

(75) Inventors: Mitsuo Yokozawa, Nagano (JP); Shogo Tanaka, Nagano (JP)

(73) Assignee: NIDEC CORPORATION (JP)

( * ) Notice: Subject to any disclaimer, the term of this patent is extended or adjusted under 35 U.S.C. 154(b) by 199 days.

(21) Appl. No.: 13/556,340

(22) Filed: Jul. 24, 2012

(65) Prior Publication Data

US 2013/0028764 A1 Jan. 31, 2013

(30) Foreign Application Priority Data

Jul. 25, 2011 (JP) ..... 2011-162572

(51) Int. Cl.

| | |
|---|---|
| ***F04D 29/40*** | (2006.01) |
| ***F04D 29/42*** | (2006.01) |
| ***F04D 29/08*** | (2006.01) |
| ***F04D 13/06*** | (2006.01) |
| ***F04D 5/00*** | (2006.01) |

(52) U.S. Cl.

CPC ..... *F04D 29/40* (2013.01); *F04D 5/006* (2013.01); *F04D 13/0673* (2013.01); *F04D 29/42* (2013.01); *F04D 29/426* (2013.01); *F04D 29/4286* (2013.01); *F04D 13/0626* (2013.01); *F04D 29/086* (2013.01)

(58) Field of Classification Search

CPC ..... F04D 13/06; F04D 29/40; F04D 29/406; F04D 29/42; F04D 29/426; F04D 29/628; F04D 29/605; F04D 29/08; F04D 29/086; F04D 29/4286; F04D 13/0626

USPC ..... 417/7, 11, 14, 360, 423.1, 423.7, 417/423.11, 423.15; 310/62, 89

See application file for complete search history.

(56) References Cited

U.S. PATENT DOCUMENTS

| | | | | |
|---|---|---|---|---|
| 6,808,371 | B2 * | 10/2004 | Niwatsukino et al. | 417/353 |
| 7,976,271 | B2 * | 7/2011 | LaRose et al. | 415/104 |
| 2005/0226745 | A1 * | 10/2005 | Seko et al. | 417/423.14 |
| 2006/0099089 | A1 * | 5/2006 | Hong et al. | 417/366 |
| 2006/0171801 | A1 * | 8/2006 | Manabe et al. | 415/176 |
| 2009/0303621 | A1 * | 12/2009 | Sue et al. | 359/824 |

FOREIGN PATENT DOCUMENTS

JP 2009-156242 A 7/2009

* cited by examiner

*Primary Examiner* — Alexander Comley
*Assistant Examiner* — Christopher Brunjes
(74) *Attorney, Agent, or Firm* — Cantor Colburn LLP

(57) ABSTRACT

A pump device may include a first case provided with a circular ring-shaped protruded part, a second case provided with a circular ring-shaped stepped part into which the circular ring-shaped protruded part is coaxially inserted, an O-ring which is mounted on a circular outer peripheral face of the circular ring-shaped protruded part and is crushed between the circular outer peripheral face of the circular ring-shaped protruded part and a circular inner peripheral face of the circular ring-shaped stepped part in a direction perpendicular to an axial line of the circular ring-shaped protruded part, and a turning prevention mechanism which prevents the first case and the second case from being relatively turned to each other around the axial line when the circular ring-shaped protruded part of the first case is inserted into the circular ring-shaped stepped part of the second case to form the pump chamber.

11 Claims, 7 Drawing Sheets

PUMP DEVICE WITH TURNING PREVENTION PROTRUDED PART TO PREVENT TURNING OF A FIRST CASE RELATIVE TO A SECOND CASE

CROSS REFERENCE TO RELATED APPLICATION

The present invention claims priority under 35 U.S.C. §119 to Japanese Application No. 2011-162572 filed Jul. 25, 2011, the entire content of which is incorporated herein by reference.

FIELD OF THE INVENTION

At least an embodiment of the present invention may relate to a pump device in which a pump case is structured of two cases which are superposed on each other.

BACKGROUND

A pump device for pressure-feeding liquid is disclosed in Japanese Patent Laid-Open No. 2009-156242 in which a pump case provided with a pump chamber in its inside is structured of a cover part and a bottom part which are superposed on each other in an upper and lower direction. In this pump device, an O-ring is disposed between the cover part and the bottom part and, when a screw is tightened for fixing the cover part and the bottom part, the O-ring is pressurized and thereby leakage of liquid from the pump chamber is prevented.

In such a pump device whose pump case is structured of two members, when the two members are superposed on each other to form a pump chamber, and when an O-ring disposed between two cases is damaged for example by turning the cover part in relation to the bottom part, the resulting effect is a reduction in preventing leakage of liquid from the pump chamber.

SUMMARY

In view of the problem described above, at least an embodiment of the present invention may advantageously provide a pump device in which damage of an O-ring disposed between two members structuring the pump case is prevented or reduced.

According to at least an embodiment of the present invention, there may be provided a pump device including a first case provided with a circular ring-shaped protruded part, a second case which is provided with a circular ring-shaped stepped part into which the circular ring-shaped protruded part is coaxially inserted and which partitions a pump chamber on an inner peripheral side of the circular ring-shaped stepped part together with the first case, an O-ring which is mounted on a circular outer peripheral face of the circular ring-shaped protruded part and is crushed between the circular outer peripheral face of the circular ring-shaped protruded part and a circular inner peripheral face of the circular ring-shaped stepped part in a direction perpendicular to an axial line of the circular ring-shaped protruded part, and a turning prevention mechanism which prevents the first case and the second case from being relatively turned to each other around the axial line when the circular ring-shaped protruded part of the first case is inserted into the circular ring-shaped stepped part of the second case to form the pump chamber.

According to at least an embodiment of the present invention, when a pump chamber is to be partitioned by inserting the circular ring-shaped protruded part of the first case into the circular ring-shaped stepped part of the second case, the first case and the second case are prevented from being relatively turned to each other around an axial line by the turning prevention mechanism. Therefore, the O-ring which is mounted on the circular outer peripheral face of the circular ring-shaped protruded part and is pressurized in a radial direction between the circular outer peripheral face of the circular ring-shaped protruded part and the circular inner peripheral face of the circular ring-shaped stepped part is prevented from being twisted in a circumferential direction when the pump case is to be assembled. In this case, when the O-ring is twisted in the circumferential direction in a state that the O-ring is pressurized in the radial direction, damage may be occurred in the O-ring. However, according to the embodiment of the present invention, the O-ring is prevented from being twisted in the circumferential direction and thus the damage of the O-ring is prevented or reduced.

In at least an embodiment of the present invention, the turning prevention mechanism includes a turning preventing protruded part which is provided in one of the first case and the second case and is extended toward the other case, and a recessed part which is provided in the other case so that the turning preventing protruded part is capable of being fitted to the recessed part in an axial direction. According to this structure, the turning prevention mechanism is simply structured. Specifically, it may be structured that, when the circular ring-shaped protruded part of the first case is inserted into the circular ring-shaped stepped part of the second case and thereby the O-ring is pressurized in a radial direction between the circular outer peripheral face of the circular ring-shaped protruded part and the circular inner peripheral face of the circular ring-shaped stepped part, the protruded part structuring the turning prevention mechanism is abutted with a side face of the recessed part in a circumferential direction around the axial line. According to this structure, the relative turning is prevented surely. Further, when the turning prevention mechanism for preventing relative turning is structured by utilizing engagement of the protruded part with the recessed part, for example, in a case that malfunction is occurred in the pump device and thus the pump case is required to be disassembled into a first case and a second case for finding out a cause of the malfunction, even when the pump case is disassembled, the first case and the second case are prevented from being relatively turned. Therefore, the damage of the O-ring is prevented or reduced at the time of disassembling of the pump device.

In this case, it is preferable that, in a state that the pump chamber is partitioned by the first case and the second case, a gap space is formed between a tip end part of the turning preventing protruded part inserted to the recessed part and a bottom face of the recessed part, and an opening part through which the tip end part of the turning preventing protruded part and the gap space are visible from an outer side is formed in the other of the first case and the second case where the recessed part is formed. According to this structure, when a flat tip screwdriver is inserted into the gap space through the opening part and then a force is applied in a direction separating the tip end part of the turning preventing protruded part from the bottom face of the recessed part, the pump case is disassembled into the first case and the second case.

In at least an embodiment of the present invention, the circular ring-shaped protruded part of the first case is provided with a radial direction protruded part in a circular ring shape which protrudes from the circular outer peripheral face to an outer side in the radial direction by a predetermined dimension at a separated position in an axial line direction from the circular ring-shaped end face of the circular ring-shaped stepped part, a circular ring-shaped tip end face of a tip end of the circular ring-shaped protruded part is abutted with a circular ring-shaped end face of the circular ring-shaped stepped part, a circular outer peripheral face of the radial direction protruded part is abutted with a circular inner peripheral face of the circular ring-shaped stepped part, and the O-ring is disposed between a circular ring-shaped end face of the radial direction protruded part and a circular ring-shaped end face of the circular ring-shaped stepped part which face in the axial line direction. According to this structure, the first case and the second case are positioned in the axial line direction by abutting the circular ring-shaped tip end face of the circular ring-shaped protruded part with the circular ring-shaped end face of the circular ring-shaped stepped part and, in addition, the first case and the second case are positioned in the radial direction by abutting the circular outer peripheral face of the radial direction protruded part with the circular inner peripheral face of the circular ring-shaped stepped part. Further, since the circular outer peripheral face of the radial direction protruded part and the circular inner peripheral face of the circular ring-shaped stepped part are abutted with each other, a distance between the circular outer peripheral face of the circular ring-shaped protruded part and the circular inner peripheral face of the circular ring-shaped stepped part, between which the O-ring is mounted, is determined in a predetermined dimension at every position in the circumferential direction and thus the O-ring is uniformly crushed in the radial direction. Therefore, sealing performance by the O-ring is improved. Further, in a case that the circular ring-shaped protruded part is to be inserted into the circular ring-shaped stepped part, even when the O-ring mounted on the circular ring-shaped protruded part is moved in the axial line direction, the movement of the O-ring is prevented by the radial direction protruded part. Therefore, the O-ring is not sandwiched in the axial line direction between the first case and the second case at a displaced position and thus the damage of the O-ring is restrained.

In this case, it is preferable that a protruded part which structures the turning prevention mechanism is provided in the first case, a tip end of the protruded part is located at the same position in the axial line direction as a circular ring-shaped tip end face of the circular ring-shaped protruded part, or is located on a side of the second case in the axial line direction with respect to the circular ring-shaped tip end face of the circular ring-shaped protruded part. According to this structure, the tip end of the protruded part of the turning prevention mechanism can be inserted into the recessed part at the same time when the circular ring-shaped protruded part of the first case is inserted into the circular ring-shaped stepped part of the second case, or before the circular ring-shaped protruded part of the first case is inserted into the circular ring-shaped stepped part of the second case. Therefore, when the first case and the second case are superposed on each other to form and partition the pump chamber, the first case and the second case are surely prevented from being relatively turned to each other.

In at least an embodiment of the present invention, the first case and the second case are fixed to each other by plural screws extending in the axial line direction. When the first case and the second case are fixed to each other by a screw, they can be easily disassembled. Further, the first case and the second case are positioned in the axial line direction by abutting the circular ring-shaped tip end face of the circular ring-shaped protruded part with the circular ring-shaped end face of the circular ring-shaped stepped part and thus, even when the screw extending in the axial line direction is tightened, the O-ring 26 is not damaged through tightening and pressurizing of the screw.

In at least an embodiment of the present invention, planar shapes of the first case and the second case when viewed in the axial line direction are rectangular, and the turning prevention mechanism is structured at corner portions of the first case and the second case. The corner portion is a portion as a dead space with respect to the circular ring-shaped protruded part in the first case in a rectangular shape and is a portion as a dead space with respect to the circular ring-shaped stepped part in the second case in a rectangular shape. Therefore, when the turning prevention mechanism is structured by utilizing the dead space, increase of the size in the radial direction of the pump case is restrained.

In at least an embodiment of the present invention, the pump device includes a rotor provided with a circular ring-shaped impeller and a drive magnet, and a stator which is provided with a drive coil and a stator core around which the drive coil is wound. The rotor is disposed between the first case and the second case in a state that the impeller is disposed within the pump chamber, and the stator is fixed to the first case on an opposite side to the pump chamber, or the stator is fixed to the second case on an opposite side to the pump chamber, and the stator is sealed by a sealing agent. According to this structure, when the pump case is disassembled, liquid such as water which is remained in the pump chamber is prevented from touching the stator provided with electrical conductive parts.

In at least an embodiment of the present invention, the stator core is provided with a ring-shaped part on a center side and a plurality of salient poles protruding from the ring-shaped part to an outer side in a radial direction, the first case is provided with a center protruded part to which the ring-shaped part of the stator core is attached, a cylindrical tube part which is coaxially structured with the center protruded part and is abutted with outer peripheral faces of the salient poles of the stator core, and an inner side ring-shaped part which connects an opening end of the center protruded part and a lower end part of the cylindrical tube part and thereby a stator accommodating room which accommodates the stator is formed, a magnet accommodating space for accommodating the drive magnet in a cylindrical tube shape is formed together with the pump chamber between the first case structured to provide with the cylindrical tube part, the circular ring-shaped protruded part, and an outer side ring-shaped part which connects an upper end part of the cylindrical tube part with an upper end part of the circular ring-shaped protruded part and the second case on an inner peripheral side of the circular ring-shaped stepped part, and outer peripheral faces of the salient poles and an inner peripheral face of the drive magnet face each other through the cylindrical tube part of the first case.

Further, in at least an embodiment of the present invention, the second case is provided with a bottom plate part, a side wall part in a ring shape which is stood up and extended upward from an outer peripheral side portion of the bottom plate part, and a circular recessed part which is formed of the bottom plate part and the side wall part, the circular ring-shaped stepped part is formed on an inner peripheral face of an upper side portion of the side wall part, and grooves which are served as a liquid flow passage are formed on the circular ring-shaped tip end face of the circular ring-shaped protruded part and the bottom plate part of the second case at positions on an inner side with respect to the circular ring-shaped stepped part. In this case, it may be structured that the circular ring-shaped impeller is structured so that an outer peripheral portion of a disk part is formed with a large number of recessed parts in a circumferential direction which are formed in two rows in an upper and lower direction, the recessed parts comprise upper side recessed parts which are formed by cutting out a circumferential edge of an upper face of the disk part and lower side recessed parts which are formed by cutting out a circumferential edge of an under face of the disk part, portions between the recessed parts which are adjacent to each other in the circumferential direction are structured as blades which are respectively extended in the radial direction, and the upper side recessed parts and the lower side recessed parts respectively face the groove formed on the circular ring-shaped tip end face of the circular ring-shaped protruded part and the groove formed on the bottom plate part of the second case and thereby the liquid flow passage is structured.

Further, in at least an embodiment of the present invention, the first case is provided with a frame-shaped outer peripheral wall which protrudes to an upper side along a circumferential edge of the first case, a base plate for supplying an electric current to the drive coil is disposed in a space which is provided on an inner side with respect to the frame-shaped outer peripheral wall so as to cover the stator disposed in the stator accommodating room, and a sealing agent is poured into the stator accommodating room of the first case and the space provided on the inner side of the frame-shaped outer peripheral wall and thereby the stator and the base plate are covered and fixed by the sealing agent. According to this structure, the stator and the base plate are surely sealed and fixed by the sealing agent.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENTS

Figure 1A:
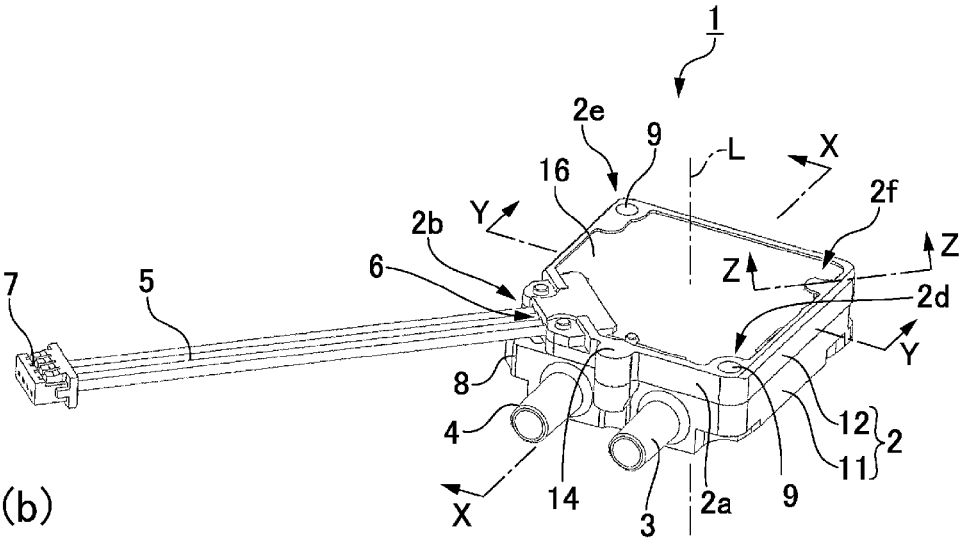
FIGS. 1(*a*), 1(*b*) and 1(*c*) are perspective views and a front view showing a pump device in accordance with an embodiment of the present invention.

A pump device in accordance with an embodiment of the present invention will be described below with reference to the accompanying drawings. In the following description, for convenience of explanation, upper and lower sides with respect to the pump device are described according to an upper and lower direction in the drawing. Further, a side from which a suction pipe and a discharge pipe are protruded is referred to as a front side of the pump device and its opposite side is referred to as a rear side and an arrangement direction of the suction pipe and the discharge pipe is referred to as a widthwise direction of the device.

(Entire Structure)

Figure 1B:
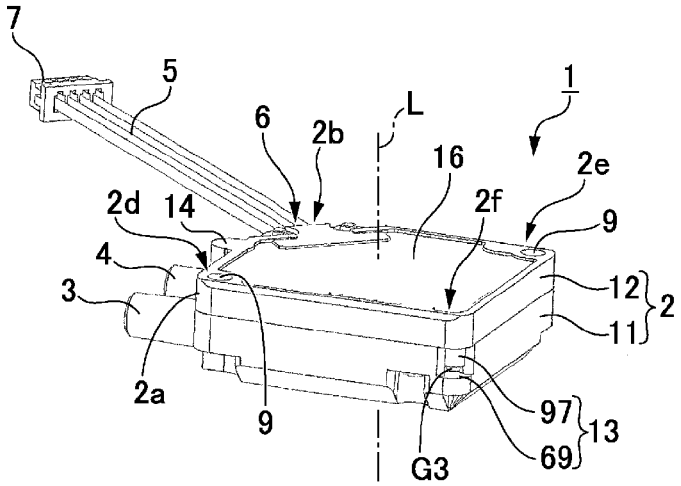
Figure 1C:
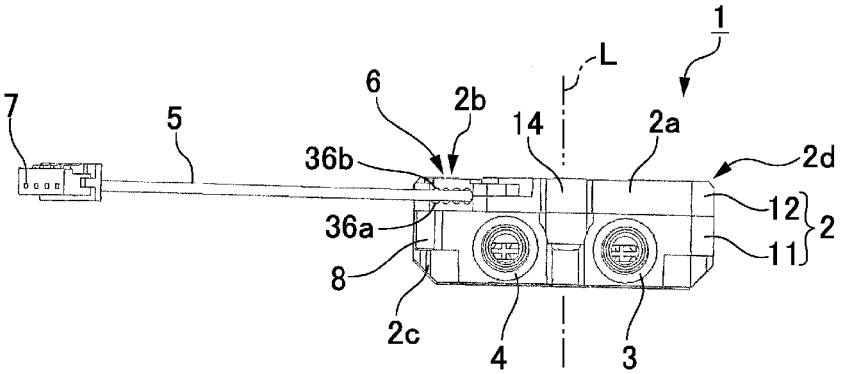

FIG. 1(*a*) is a perspective view showing a pump device in accordance with an embodiment of the present invention which is viewed from a forward oblique upper side, FIG. 1(*b*) is a perspective view showing the pump device which is viewed from a rearward oblique upper side, and FIG. 1 (*c*) is a front view showing the pump device. A pump device 1 in accordance with an embodiment of the present invention is a vortex pump in which liquid such as refrigerant is pressure-fed. The pump device 1 is provided with a pump case 2 which is formed in a rectangular prism shape as a whole. The pump case 2 is made of resin such as PPS (polyphenylene sulfide). A suction pipe 3 and a discharge pipe 4 are protruded in parallel toward the front side from a front face 2*a* of the pump case 2. A wiring outlet part 6 for taking out lead wires 5 from an inner side of the pump case 2 is provided at a corner portion 2*b* located on a front left side between the front face 2*a* of the pump case 2 and a side face adjacent to the front face 2*a* in a clockwise direction. The lead wires 5 are drawn out from a midway position in an axial line "L" direction (height direction) of the pump device 1 through the wiring outlet part 6 toward an obliquely front side. The lead wire 5 is bendable and is extended longer than the suction pipe 3 and the discharge pipe 4 and a connector 7 is attached to tip ends of the lead wires 5.

An inclined face 2*c* (see FIG. 1(*c*)) intersecting the front face 2*a* and the side face and extending in the axial line "L" direction is formed at the corner portion 2*b* located on the front left side of the pump case 2 where the wiring outlet part 6 is provided by obliquely cutting out a tip end of the corner portion 2*b*. Further, a hook 8 is provided at the corner portion 2*b* located on the front left side for locking the lead wires 5 when the lead wires 5 are extended out along the inclined face 2*c*. The hook 8 is extended in a direction perpendicular to the axial line "L" along the inclined face 2*c* at a center position in the axial line "L" direction of the inclined face 2*c*. Further, the hook 8 is extended with a constant width from the front face 2*a* side to a side of the side face. An attaching hole 9 for attaching the pump device 1 to an external apparatus is formed in the corner portion 2*d* on the front right side of the pump case 2 and the corner portion 2*e* on the rear right side located at a diagonal position to the corner portion 2*d*.

The pump case 2 is structured of a lower case (second case) 11 and an upper case (first case) 12 which are superposed on each other in the upper and lower direction. The suction pipe 3 and the discharge pipe 4 are protruded from the front face of the lower case 11. The wiring outlet part 6 is provided at the corner portion on the front left side of the upper case 12. The hook 8 is provided on the lower case 11.

In this embodiment, a corner portion 2*f* on the rear right side of the pump case 2 which is located at a position diagonal to the wiring outlet part 6 is provided with a turning prevention mechanism 13 (see FIG. 1(*b*)) for preventing relative turning of the lower case 11 to the upper case 12 when the lower case 11 and the upper case 12 are superposed on each other. Further, a case fixing part 14 is provided between the suction pipe 3 and the discharge pipe 4 of the pump case 2 so as to protrude from the front face 2*a*. The case fixing part 14 is a portion where the lower case 11 and the upper case 12 are fixed to each other by using a screw 15.

Figure 2A:
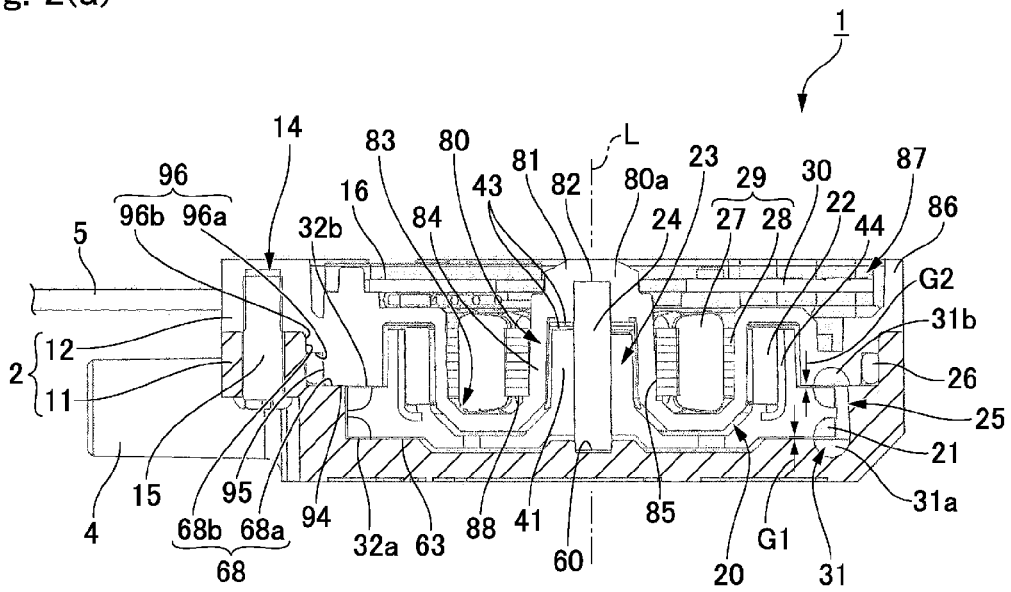
FIGS. 2(*a*) and 2(*b*) are cross-sectional views showing a pump device in accordance with an embodiment of the present invention.
Figure 2B:
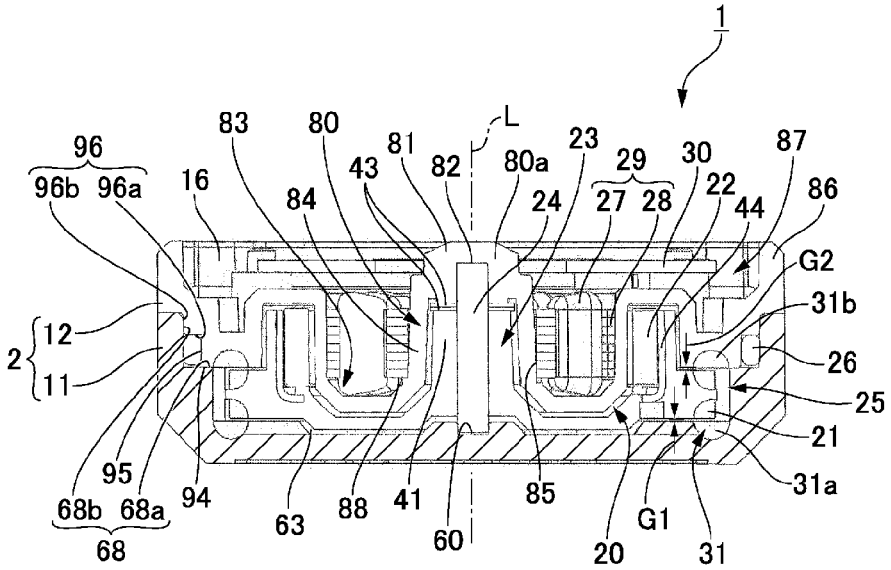
Figure 3:
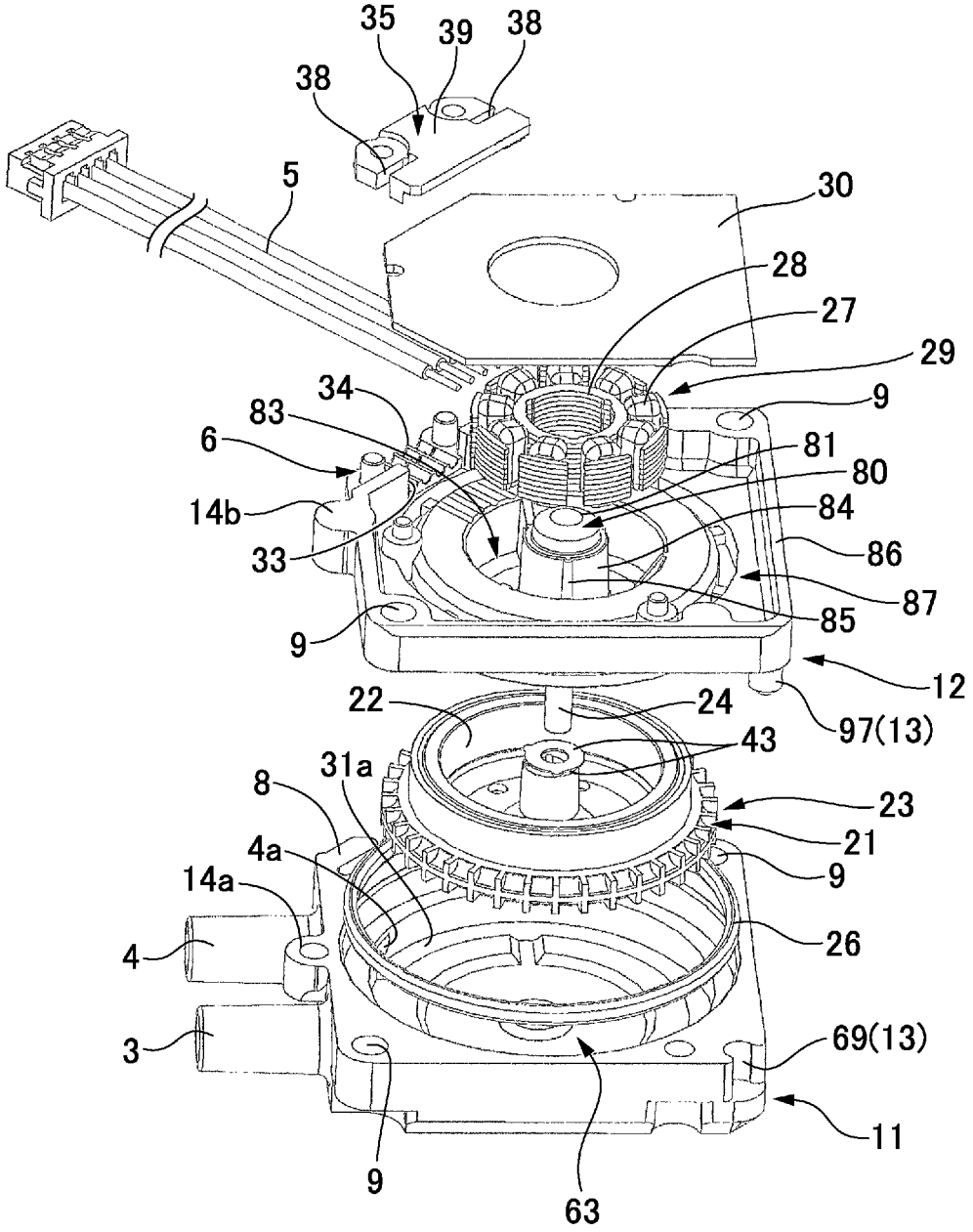
FIG. 3 is an exploded perspective view showing a pump device in accordance with an embodiment of the present invention.
Figure 4A:
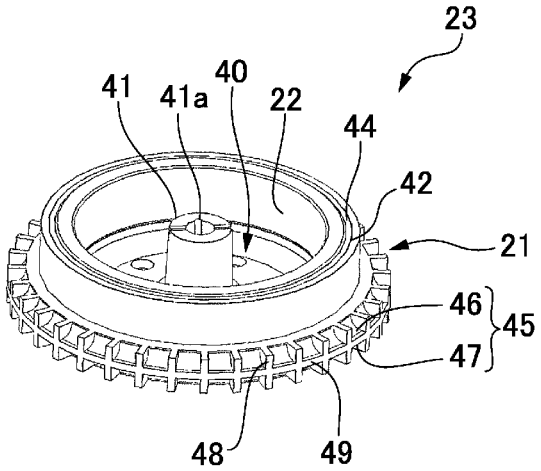
FIG. 4(*a*) is a perspective view showing a rotor and FIG. 4(*b*) is a perspective view showing a stator.
Figure 4B:
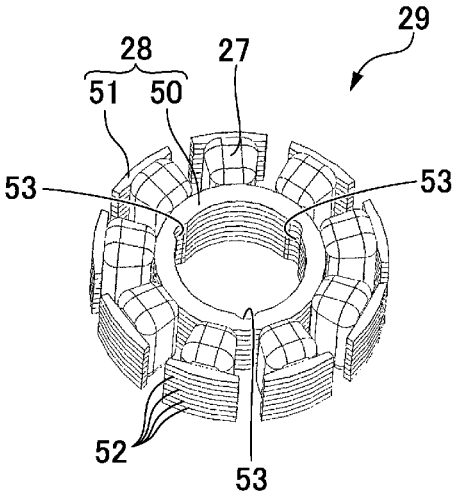

FIG. 2(*a*) is a longitudinal sectional view showing the pump device 1 which is cut by the "X-X" line in FIG. 1(*a*) and FIG. 2(*b*) is a longitudinal sectional view showing the pump device 1 which is cut by the "Y-Y" line in FIG. 1(*a*). FIG. 3 is an exploded perspective view showing the pump device 1. FIG. 4(*a*) is a perspective view showing a rotor and FIG. 4(*b*) is a perspective view showing a stator.

As shown in FIGS. 2(*a*) and 2(*b*) and FIG. 3, the lower case 11 and the upper case 12 are superposed on each other in a partially overlapped state in a direction perpendicular to the axial line "L". A partitioned chamber 20 for accommodating a rotor and for forming a pump chamber is structured between the lower case 11 and the upper case 12. A rotor 23 provided with a circular ring-shaped impeller 21 and a drive magnet 22 and a support shaft 24 which rotatably supports the rotor 23 are disposed in the partitioned chamber 20. Further, an outer peripheral side portion of the partitioned chamber 20 is structured to be a circular ring-shaped pump chamber 25 through which liquid is pressure-fed by the impeller 21 and the impeller 21 structuring the rotor 23 is disposed within the pump chamber 25. An O-ring 26 is disposed between the lower case 11 and the upper case 12 for preventing leakage of liquid from the partitioned chamber 20. A stator 29 provided with a drive coil 27 and a stator core 28, on which the drive coil 27 is mounted, and a base plate 30 are disposed on an upper side of the upper case 12 which is opposite to the side where liquid is pressure-fed, in other words, on an opposite side to the partitioned chamber 20 with respect to the upper case 12 (opposite side to the lower case 11). The drive magnet 22, the stator core 28 and the drive coil 27 wound around the stator core 28 structure a magnetic drive mechanism for rotationally driving the impeller 21.

A liquid flow passage 31 is formed on a bottom face and a ceiling face of the pump chamber 25 over a predetermined angular range around the axial line "L". More specifically, a lower side liquid flow passage 31*a* formed of a circular arc groove having a semicircular cross-sectional shape is formed on the bottom face of the pump chamber 25 which is structured by the lower case 11, and an upper side liquid flow passage 31*b* formed of a circular arc groove having a semicircular cross-sectional shape is formed on the ceiling face of the pump chamber 25 which is structured by the upper case 12. The lower side liquid flow passage 31*a* and the upper side liquid flow passage 31*b* are superposed on each other when viewed in the axial line "L" direction. In this embodiment, the liquid flow passage 31 is formed over an angular range approximately larger than 270° around the axial line "L".

Figure 5A:
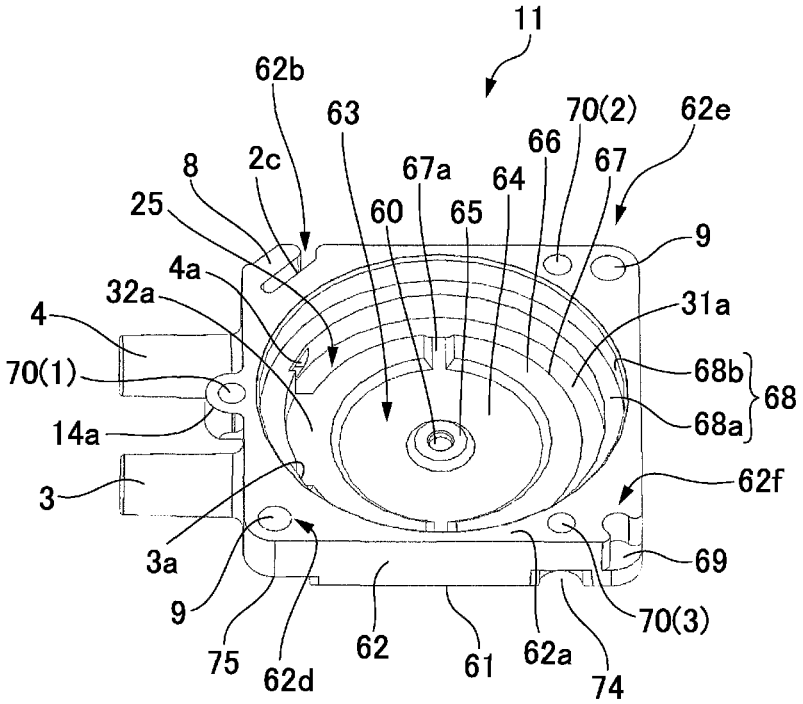
FIGS. 5(*a*) and 5(*b*) are perspective views showing a lower case.
Figure 5B:
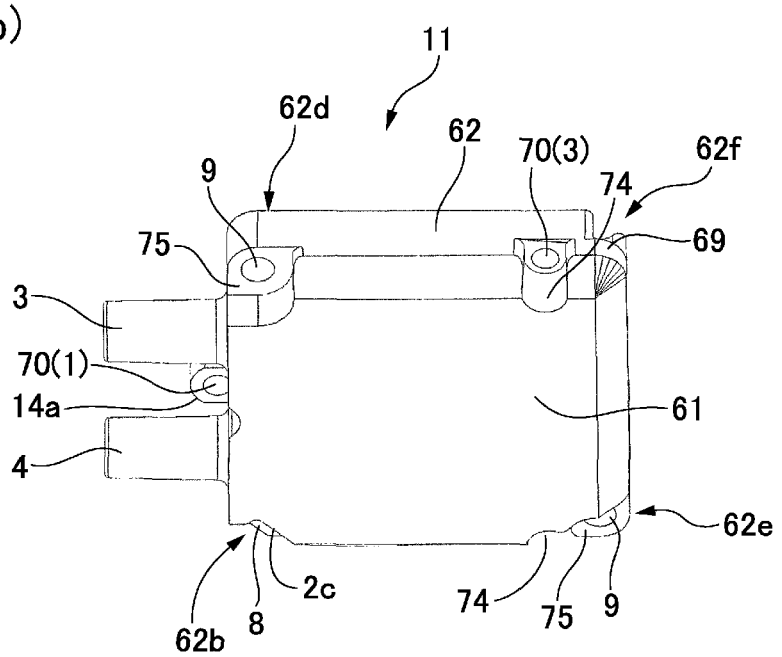

In the pump chamber 25, a suction port 3*a* (see FIG. 5(*a*)) which is in communication with the suction pipe 3 is provided at a portion of the lower case 11 where one end of the liquid flow passage 31 is located. Further, a discharge port 4*a* (see FIG. 3 and FIG. 5(*a*)) which is in communication with the discharge pipe 4 is provided at a portion of the lower case 11 where the other end of the liquid flow passage 31 is located. A portion of the bottom face of the pump chamber 25 which is located between the suction port 3*a* and the discharge port 4*a* is formed as a lower side blocking part 32*a* where the lower side liquid flow passage 31*a* is not formed. Similarly, a portion of the ceiling face of the pump chamber 25 which is located between the suction port 3*a* and the discharge port 4*a* is formed as an upper side blocking part 32*b* where the upper side liquid flow passage 31*b* is not provided.

A support shaft 24 is made of stainless steel and its lower end portion is fixed to a support shaft fixing recessed part 60 which is provided in the lower case 11. Further, its upper end portion is fixed to a support shaft fixing recessed part 82 which is provided at a center of a bottom part 81 of a center protruded part 80 formed in a bottomed tube-like shape that is provided at the center portion of the upper case 12.

The rotor 23 is provided with, as shown in FIG. 4(*a*), a disk part 40, a bearing part 41 in a cylindrical tube shape which is protruded upward from a center of an upper face of the disk part 40, and a magnet holding cylindrical tube part 42 which is protruded upward from the upper face of the disk part 40 so as to coaxially surround the bearing part 41 with a predetermined distance from the bearing part 41, which are made of resin such as PPS. The predetermined distance between the bearing part 41 and the cylindrical tube part 42 is a distance in which the stator 29 is capable of being accommodated therebetween through the upper case 12. The rotor 23 is rotatable around the axial line "L" of the support shaft 24 in a state that the support shaft 24 is inserted into a center hole 41*a* of the bearing part 41 and the bearing part 41 is disposed on an inner side of the center protruded part 80 of the upper case 12. One piece or plural pieces of washer 43 is fitted between an upper end of the bearing part 41 and a bottom part 81 of the center protruded part 80 and the position of the rotor 23 in the axial line "L" direction with respect to the stator 29 is adjusted by fitting of the washer 43 (see FIGS. 2(*a*) and 2(*b*)). In this embodiment, two pieces of washer are attached. For example, when one or two pieces of a washer 43 whose thickness is 0.2 mm and a washer 43 whose thickness is 0.3 mm are selected, a total thickness of the washers 43 can be adjusted in a range from 0.2 mm to 0.6 mm with an interval of 0.1 mm.

A yoke 44 in a cylindrical tube shape is held on an inner peripheral face of the magnet holding cylindrical tube part 42 and the drive magnet 22 in a cylindrical tube shape is held on an inner peripheral face of the yoke 44. The yoke 44 is integrally formed with the rotor 23 by insert molding and the drive magnet 22 is adhesively fixed to the yoke 44. An outer peripheral portion on an outer peripheral side in the disk part 40 with respect to the cylindrical tube part 42 is structured as the impeller 21.

An outer peripheral portion of the impeller 21 is formed with recessed parts 45 which are formed in two rows in the upper and lower direction at an equal angular interval in the circumferential direction. The recessed parts 45 are provided with upper side recessed parts 46, which are formed by cutting a circumferential edge of an upper face of the disk part 40 in a circular arc shape, and lower side recessed parts 47 which are formed by cutting a circumferential edge of an under face of the disk part 40 in a circular arc shape. Portions between the recessed parts 45 adjacent to each other in the circumferential direction are formed as blades 48 which are respectively extended in a radial direction. A portion between the upper side recessed parts 46 and the lower side recessed parts 47 which are adjacent to each other in the upper and lower direction is extended in the circumferential direction and is formed to be a rib 49 partitioning the respective blades 48 in the upper and lower direction. The impeller 21 is, as shown in FIGS. 2(*a*) and 2(*b*), inserted into the pump chamber 25.

The stator 29 is disposed within a stator accommodating room 83 in a circular ring-shaped recessed part which is provided on an outer peripheral side of the center protruded part 80 and on an upper face side of the upper case 12. A stator core 28 is, as shown in FIG. 4(*b*), provided with a ring-shaped part 50 on its center side and a plurality of salient poles 51 which are protruded from the ring-shaped part 50 to an outer side in the radial direction. A drive coil 27 is wound around each of a plurality of the salient poles 51. As shown in FIGS. 2(*a*) and 2(*b*), each of the salient poles 51 is oppositely disposed through the upper case 12 in a direction perpendicular to the axial line "L" to the drive magnet 22 of the rotor 23 which is disposed within the partitioned chamber 20 that forms a magnet accommodating space in which the circular ring-shaped drive magnet 22 is accommodated. The upper case 12 is disposed between the rotor 23 and the stator 29 to be functioned as a partition wall separating the pump chamber 25 and the magnet accommodating space from the stator 29.

The stator core 28 is structured so that a plurality of plate-shaped core pieces 52 having the same shape which are formed by die cutting a thin plate-shaped magnetic steel plate is laminated in the upper and lower direction and a laminated direction of the plate-shaped core pieces 52 is the axial line "L" direction. An inner peripheral face of the ring-shaped part 50 of the stator core 28 is formed with three inner side recessed parts 53 whose cross-sectional shape in a direction perpendicular to the axial line "L" is semicircular at an equal angular interval around the axial line "L". Three inner side recessed parts 53 are the same shape and are extended in the axial line "L" direction. The depths in the radial direction of the respective inner side recessed parts 53 are the same and its cross-sectional shape is the same at each position in the axial line "L" direction.

In this embodiment, as shown in FIG. 3, an outer peripheral face of the tube shaped part 84 of the center protruded part 80 of the upper case 12 is formed with three stator fixing protruding parts 85 which are protruded to outer sides in a radial direction from parts in the circumferential direction. The stator fixing protruding parts 85 are press-fitted to the inner side recessed parts 53 of the ring-shaped part 50 and thereby the stator core 28 is fixed to the center protruded part 80. Further, the outer peripheral face of the tube shaped part 84 of the center protruded part 80 is formed with a positioning part 88 (see FIGS. 2(*a*) and 2(*b*) and FIG. 6(*a*)) at a position separated from the stator fixing protruding parts 85 in the circumferential direction so as to be abutted with the ring-shaped part 50 of the stator core 28 from the underside in the axial line "L" direction to position the stator core 28 in the axial line "L" direction. After the stator fixing protruding parts 85 are press-fitted to the inner side recessed parts 53 of the ring-shaped part 50, the stator core 28 is abutted with the positioning part 88 and is positioned in the axial line "L" direction.

Specifically, a cross-sectional shape perpendicular to the axial line "L" of each of three stator fixing protruding parts 85 formed on the outer peripheral face of the center protruded part 80 is a semicircular shape and three stator fixing protruding parts 85 are formed at an equal angular interval around the axial line "L" of the support shaft 24. Further, three stator fixing protruding parts 85 are formed to be the same shape as each other and are respectively extended in the axial line "L" direction along the outer peripheral face of the center protruded part 80 so as to be provided with a tapered face whose protruding amount to an outer side in the radial direction and in the circumferential direction is increased from a side of the bottom part 81 toward a side of the opening end, in other words, from the upper side to the lower side. The stator core 28 is fitted into the stator accommodating room 83 in a state that the stator fixing protruding parts 85 of the center protruded part 80 are to be fitted to the inner side recessed parts 53 of the ring-shaped part 50 and, after that, the lower end portions of the respective stator fixing protruding parts 85 are press-fitted to the inner side recessed parts 53 of the ring-shaped part 50 and thereby the stator core 28 is fixed to the upper case 12. In this embodiment, in a state that the lower end portion of the stator fixing protruding part 85 is press-fitted to the inner side recessed part 53 (of preferably one piece) of the ring-shaped part 50 of the lowest side plate-shaped core piece 52 structuring the stator core 28, the ring-shaped part 50 is abutted with the positioning part 88 in the axial direction and is fixed.

A base plate 30 is disposed in an upper space 87 which is provided on an inner side of a frame-shaped outer peripheral wall 86 protruding from an upper face of the upper case 12 to an upper side along its circumferential edge. The base plate 30 serves as a circuit board for supplying an electric current to the drive coil 27 wound around the stator core 28 and covers the stator 29 disposed within the stator accommodating room 83 from the upper side. A face on the stator core 28 side of the base plate 30 is connected with the lead wires 5, which are drawn out to an outer side of the pump case 2 through the wiring outlet part 6. The wiring outlet part 6 is, as shown in FIG. 3, provided with a wiring outlet port 33 which is formed by cutting out the outer peripheral wall 86, a wire placing part 34 for arranging and placing in one row the lead wires 5 drawn out from the inner side of the pump case 2 to the outer side through the wiring outlet port 33, and a fixing member 35 which is fixed to the upper case 12 so as to close the wiring outlet port 33 from the upper side of the base plate 30 for sandwiching the lead wires 5 arranged on the wire placing part 34 between the wire placing part 34 and the fixing member 35 and thereby their coatings are fixed in a pressed state.

In this embodiment, as shown in FIGS. 1(*a*) and 1(*b*), a potting agent 16 as a sealing agent is poured into the stator accommodating room 83 and the upper space 87 of the upper case 12 so as to reach the upper end of the outer peripheral wall 86 and thus the stator 29 and the base plate 30 are covered and fixed by the potting agent 16. The potting agent 16 is resin having insulation property such as epoxy, acrylic, or silicon resin.

When an exciting current is supplied to the drive coil 27 from the connector 7 through the lead wires 5 and the base plate 30, the rotor 23 is rotated around the axial line "L". As a result, liquid is sucked into the pump chamber 25 through the suction pipe 3, pressurized in the pump chamber 25 and then ejected from the discharge pipe 4. The motor (rotor 23, stator 29 and base plate 30) which drives the pump device 1 in this embodiment is a three-phase brushless motor and three Hall elements not shown for detecting a position of the drive magnet 22 of the rotor 23 are disposed on the base plate 30. When the order of an exciting current supplied to the drive coil 27 is reversed, the rotor 23 is rotated in the reverse direction and thus, liquid is sucked through the discharge pipe 4, pressurized in the pump chamber 25 and then ejected from the suction pipe 3.

(Lower Case)

FIG. 5(*a*) is a perspective view showing the lower case 11 which is viewed from an upper side and FIG. 5(*b*) is a perspective view showing the lower case 11 which is viewed from a lower side. The lower case 11 is provided with a bottom plate part 61, a ring shaped side wall part 62 which is stood up from an outer peripheral side portion of the bottom plate part 61 so as to extend toward an upper side, and a circular recessed part 63 which is formed by the bottom plate part 61 and the side wall part 62. A contour shape of the side wall part 62 which is viewed in the axial line "L" direction is a substantially rectangular shape and a planar shape of the lower case 11 viewed in the axial line "L" direction is a substantially rectangular shape. The side wall part 62 is provided with a flat upper end face 62*a* and the upper end face 62*a* is an upper end face of the lower case 11. The pump chamber 25 is structured to be a ring-like shape along the circumferential edge of the circular recessed part 63. A support shaft fixing recessed part 60 is provided at the center of a circular bottom face of the circular recessed part 63.

A circular ring-shaped recessed part 64 is formed on an outer peripheral side of the support shaft fixing recessed part 60 coaxially with the support shaft fixing recessed part 60. A portion between the support shaft fixing recessed part 60 and the circular ring-shaped recessed part 64 is formed to be an inner side ring-shaped protruded face 65 and a portion on an outer peripheral side of the circular ring-shaped recessed part 64 is formed to be an outer side ring-shaped protruded face 66. The outer side ring-shaped protruded face 66 structuring the circular recessed part 63 is formed with a lower side liquid flow passage 31*a* structuring a bottom face of the pump chamber 25 and a lower side blocking part 32*a* along its circumferential edge. A circular ring-shaped end face portion 67 of the outer side ring-shaped protruded face 66 which is adjacent to the inner side of pump chamber 25 faces the disk part 40 of the rotor 23 which is disposed within the partitioned chamber 20 through a minute gap "G1" (see FIGS. 2(*a*) and 2(*b*)). In the circular ring-shaped end face portion 67, two grooves 67*a* having a constant width by which the lower side liquid flow passage 31*a* is in communication with the circular ring-shaped recessed part 64 are formed at positions separated from each other by 180°.

A circular ring-shaped stepped part 68 is provided on an upper side portion of the circular recessed part 63, in other words, on an inner peripheral face of an upper side portion of the side wall part 62. The circular ring-shaped stepped part 68 is provided with a circular ring-shaped end face 68*a*, which is extended in a radial direction from a midway position in the axial line "L" direction of the inner peripheral face of the side wall part 62, and a circular inner peripheral face 68*b* which is extended to an upper side from an outer circumferential edge of the circular ring-shaped end face 68*a*. The circular ring-shaped stepped part 68 forms a circular recessed part having a diameter larger than a circular recessed part 63 on an upper end portion of the lower case 11.

The suction pipe 3 and the discharge pipe 4 are protruded in parallel from the front face of the side wall part 62. An inclined face 2*c* and a hook 8 are provided at the corner portion 62*b* of the lower case 11 on a front and left side which is adjacent to the discharge pipe 4 of the side wall part 62. A turning prevention recessed part 69 structuring the turning prevention mechanism 13 is provided at a corner portion 62*e* on a rear and right side of the side wall part 62. The turning prevention recessed part 69 is a recessed part which is recessed to a lower side from the upper end face 62*a*. Further, the turning prevention recessed part 69 is cut out from the outer peripheral side and its inner peripheral face is exposed to the outer side of the lower case 11.

A lower side case fixing part 14*a* structuring the case fixing part 14 is protruded from the front face of the side wall part 62 to the front side between the suction pipe 3 and the discharge pipe 4. The lower side case fixing part 14*a* is formed with a first through hole 70(1) penetrating through in the axial line "L" direction. Further, a corner portion 62*e* on the rear and left side and a corner portion 62*f* on the rear and right side of the side wall part 62 are respectively formed with a second through hole 70(2) penetrating through in the axial line "L" direction and a third through hole 70(3) penetrating through in the axial line "L" direction. The second through hole 70(2) is formed on the front side of the attaching hole 9 and the third through hole 70(3) is formed on the front side of the turning prevention recessed part 69. In the corner portion 62*e* on the rear and left side and the corner portion 62*f* on the rear and right side of the side wall part 62, an under face portion (under face portion of the bottom plate part 61) where the second through hole 70(2) and the third through hole 70(3) are formed is formed with recessed parts 74 into which a head part of a headed screw is inserted when the lower case 11 and the upper case 12 are fixed to each other by the headed screw. In the corner portion 62*d* on the front and right side and the corner portion 62*e* on the rear and left side of the side wall part 62, an under face portion where the attaching hole 9 is formed (under face portion of the bottom plate part 61) is formed with a recessed part 75 into which a head part of a headed screw is inserted when the pump device is fixed to an external apparatus by a headed screw.

(Upper Case)

Figure 6A:
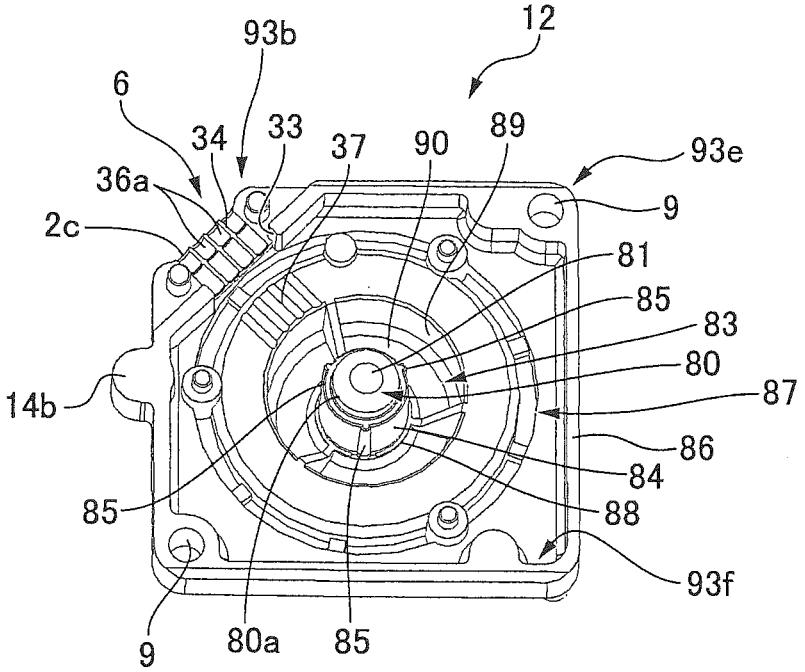
FIGS. 6(*a*) and 6(*b*) are perspective views showing an upper case.
Figure 6B:
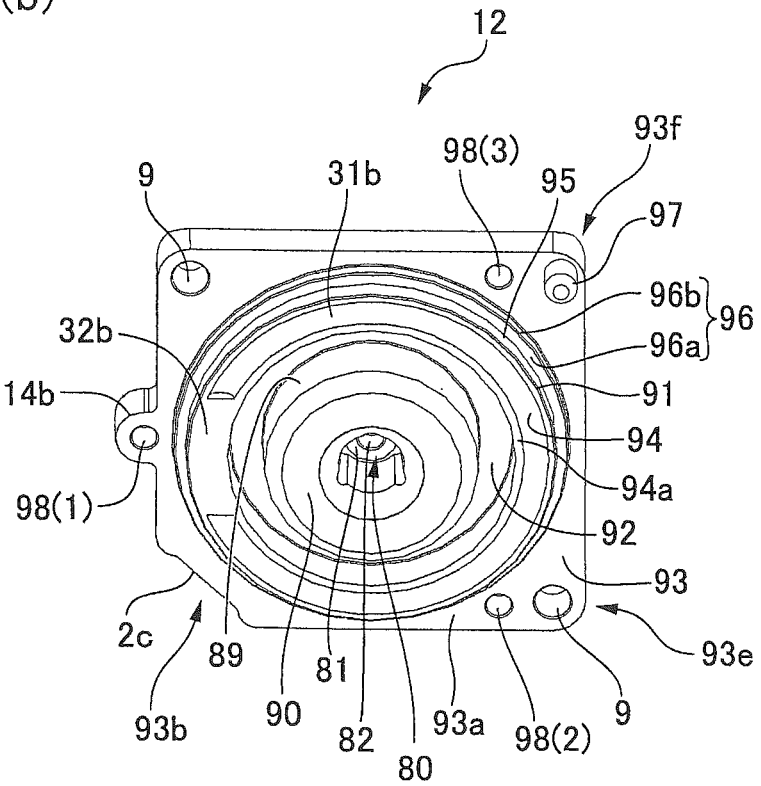

FIG. 6(*a*) is a perspective view showing the upper case 12 which is viewed from an upper side and FIG. 6(*b*) is a perspective view showing the upper case 12 which is viewed from a lower side. The upper case 12 is, as shown in FIG. 6(*a*), provided with a center protruded part 80 to which the ring-shaped part 50 of the stator core 28 is attached, a cylindrical tube part 89, which is coaxially structured with the center protruded part 80 and with which the outer peripheral faces of the salient poles 51 of the stator core 28 are abutted, and an inner side ring-shaped part 90 which connects an opening end of the center protruded part 80 with a lower end part of the cylindrical tube part 89. Further, the upper case 12 is, as shown in FIG. 6(*b*), provided with a circular ring-shaped protruded part 91, which is coaxially structured with the center protruded part 80 and the cylindrical tube part 89 on an outer peripheral side of the cylindrical tube part 89 and is protruded to a lower side, an outer side ring-shaped part 92, which connects an upper end part of the cylindrical tube part 89 with an upper end part of the circular ring-shaped protruded part 91, and a projecting part 93 which projects from an upper end part of the circular ring-shaped protruded part 91 to an outer peripheral side.

The stator accommodating room 83 in which the stator 29 is disposed is structured of faces of the center protruded part 80, the cylindrical tube part 89 and the inner side ring-shaped part 90 on an opposite side with respect to the lower case 11. The center protruded part 80 is provided on a side of the bottom part 81 with a protruding portion 80*a*, which is protruded to an upper side from an opening of the stator accommodating room 83. A thickness in the radial direction of the cylindrical tube part 89 is formed thinner than a thickness in the radial direction of the center protruded part 80. An outer peripheral wall 86 which partitions the upper space 87 in which the base plate 30 is disposed is formed on the upper face of the projecting part 93. The projecting part 93 is provided with a flat lower end face 93*a*.

A circular ring-shaped lower end face 94 (circular ring-shaped tip end face) of the circular ring-shaped protruded part 91 is formed with an upper side liquid flow passage 31*b* and an upper side blocking part 32*b*, which structures a ceiling face of the pump chamber 25, at a midway position in the radial direction on an inner side with respect to the circular ring-shaped stepped part 68. In the circular ring-shaped lower end face 94, a circular ring-shaped end face portion 94*a* which is adjacent to an inner side of the pump chamber 25 faces the disk part 40 of the rotor 23 disposed within the partitioned chamber 20 through a minute gap "G2" (see FIGS. 2(*a*) and 2(*b*)2).

A radial direction protruded part 96 protruding to an outer side by a predetermined dimension in the radial direction is provided on an upper end portion of a circular outer peripheral face 95 of the circular ring-shaped protruded part 91. The radial direction protruded part 96 is provided with a circular ring-shaped end face 96*a*, which is extended to an outer side in the radial direction from a midway position in the axial line "L" direction of the circular ring-shaped protruded part 91 so as to face the lower case 11, and a circular outer peripheral face 96*b* which is extended to an upper side from an outer circumferential edge of the circular ring-shaped end face 96*a* so as to face the outer side in the radial direction.

A contour shape of the projecting part 93 is a roughly rectangular shape and the corner portion 93*b* on the front left side is cut out obliquely to form the inclined face 2*c*. The outer peripheral wall 86 is protruded to the upper side from an outer circumferential edge of the projecting part 93 except the corner portion 93*b* having the cut-out portion. In the corner portion 93*b* on the front left side having the cut-out portion, the outer peripheral wall 86 is provided at an inner retreated position from an outer circumferential edge of the projecting part 93. Further, in the corner portion 93*b* on the front left side, the outer peripheral wall 86 is cut out with a constant width in a rectangular shape and the cut-out part is formed as the wiring outlet port 33. A portion between the wiring outlet port 33 and the outer circumferential edge of the projecting part 93 is the wire placing part 34. An upper face of the wire placing part 34 is forwith wire holding grooves 36*a* whose cross section is a circular arc shape and which are extended in parallel to an outer side in the radial direction so as to correspond to the number of the lead wires 5. Circular arc grooves 37 are formed on an inner side of the wiring outlet port 33 so as to continuously extend on the extension of the wire holding grooves 36*a*.

The fixing member 35 is, as shown in FIG. 3, formed in a planar shape which is wider than an opening width of the wiring outlet port 33 and a pair of fitting grooves 38 is formed on one edge and the other edge in the widthwise direction. The fitting grooves 38 are disposed along the same straight line and are opened so as to direct an opposite side to each other. Further, an under face of the fixing member 35 is formed with wire holding grooves 36*b* whose cross section is in a circular arc shape at facing positions to the circular arc grooves of the wire placing part 34. When the lead wires 5 are placed on the wire placing part 34 and then the fixing member 35 is fixed to the upper case 12 from the upper side so that the edge portions (side wall part) of the wiring outlet port 33 of the outer peripheral wall 86 are inserted into a pair of the fitting grooves 38, a narrowed portion 39 between a pair of the fitting grooves 38 is press-fitted into the wiring outlet port 33 and thus the lead wires 5 are placed and sandwiched between the wire holding grooves 36*a* of the wire placing part 34 and the wire holding grooves 36*b* of the fixing member 35 and are fixed in a state that their coatings are pressed. Further, an outer circumferential edge portion of the base plate 30 is pressed down from the upper side by the inner side edge portion of the fixing member 35.

The wire placing part 34 and the inclined face 2*c* are formed at the corner portion 93*b* on the front left side of the projecting part 93. A turning preventing protruded part 97 in a cylindrical shape which structures the turning prevention mechanism 13 together with the turning prevention recessed part 69 is protruded to a lower side from the corner portion 93*f* on the rear right side of the projecting part 93. An outer circumferential edge of a tip end face 97*a* (lower end face) of the turning preventing protruded part 97 is chamfered. In this embodiment, a position of the tip end face 97*a* of the turning preventing protruded part 97 is set to be the same position as the circular ring-shaped lower end face 94 of the circular ring-shaped protruded part 91 in the axial line "L" direction. Further, a protruding dimension of the turning preventing protruded part 97 is set to be shorter than a depth dimension of the turning prevention recessed part 69. In addition, when the turning preventing protruded part 97 is fitted to the turning prevention recessed part 69, the turning preventing protruded part 97 is abutted with the inner peripheral face, specifically, the side face of the turning prevention recessed part 69 in the circumferential direction around the axial line "L" without a gap space and, in the radial direction with the axial line "L" as a center, a gap space is formed between the peripheral face of the turning prevention recessed part 69 and the turning preventing protruded part 97.

An upper side case fixing part 14*b* structuring the case fixing part 14 is protruded to the front side from the front face of the projecting part 93 at a center in the widthwise direction of the device. The upper side case fixing part 14*b* is provided with a screw hole 98(1) which is recessed in the axial line "L" direction. Further, the corner portion 93*e* on the rear left side and the corner portion 93*f* on the rear right side are respectively provided with a second screw hole 98(2) recessed in the axial line "L" direction and a third screw hole 98 (3) recessed in the axial line "L" direction. The second screw hole 98(2) is formed on the front side of the attaching hole 9 and the third screw hole 98(3) is formed on the front side of the turning preventing protruded part 97.

(Partitioning of Pump Chamber)

Figure 7:
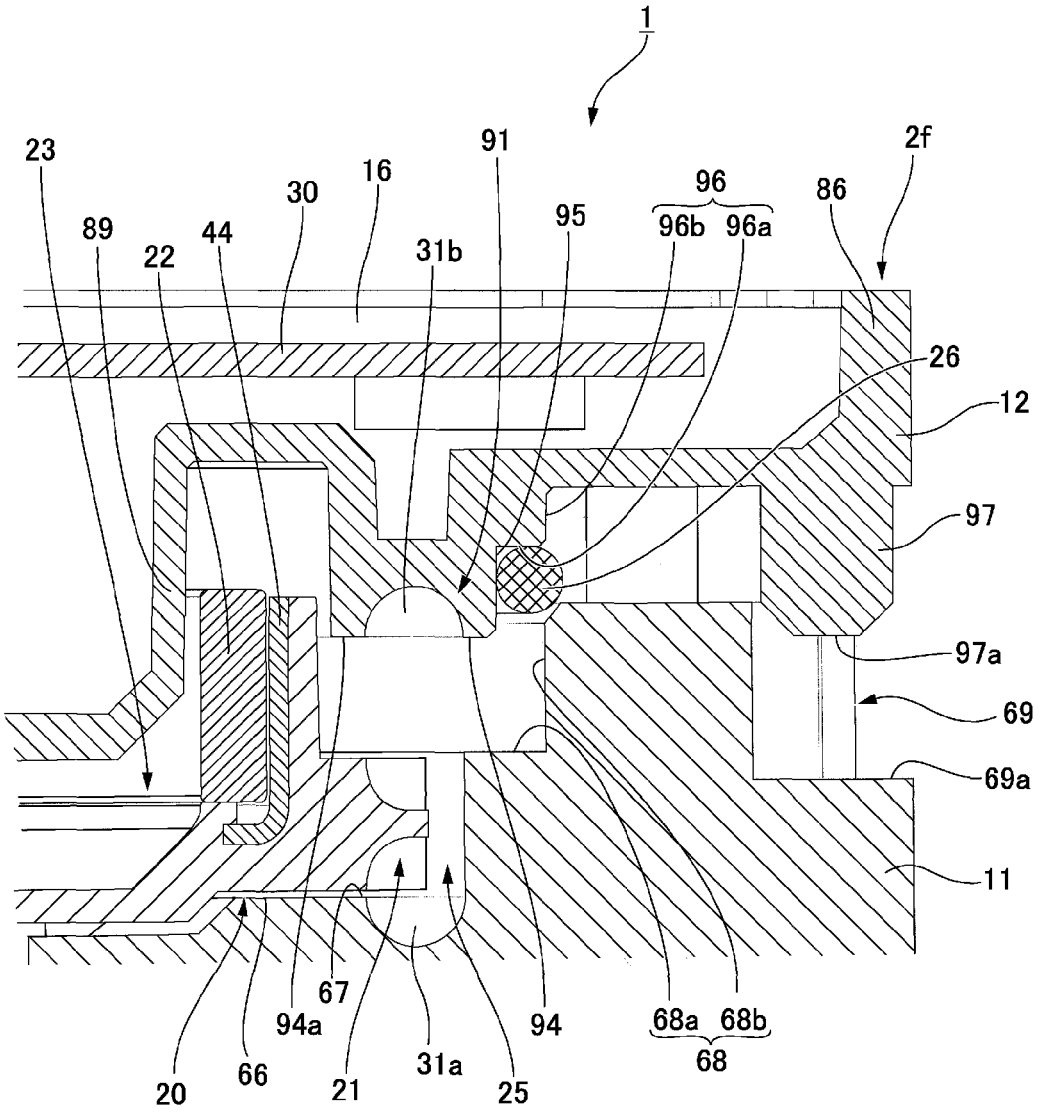
FIG. 7 is a partially sectional view showing a pump device before an upper case and a lower case are superposed on each other.

FIG. 7 is a partially sectional view showing the pump device 1 which is cut by the "Z-Z" line in FIG. 1(*a*) and which is a state that the circular ring-shaped protruded part 91 of the upper case 12 is to be inserted into the inner side of the circular ring-shaped stepped part 68 of the lower case 11. When the pump chamber 25 (partitioned chamber 20) is to be partitioned, an O-ring 26 is mounted on the circular outer peripheral face 95 of the circular ring-shaped protruded part 91 of the upper case 12. In this case, a lubricant is applied to the O-ring 26. Further, the support shaft 24 is previously fixed to the support shaft fixing recessed part 82 of the upper case 12. The rotor 23 is disposed in the circular recessed part 63 of the lower case 11 so that the support shaft 24 is capable of being inserted into the bearing part 41.

Next, the circular ring-shaped protruded part 91 of the upper case 12 is inserted into the inner side of the circular ring-shaped stepped part 68 of the lower case 11. In this embodiment, the tip end face 97*a* of the turning preventing protruded part 97 of the turning prevention mechanism 13 is set to be at the same position as the circular ring-shaped lower end face 94 of the circular ring-shaped protruded part 91 in the axial line "L" direction. Therefore, when the circular ring-shaped protruded part 91 is inserted into the inner side of the circular ring-shaped stepped part 68, the turning preventing protruded part 97 is simultaneously entered into the turning prevention recessed part 69 which is provided in the lower case 11.

After that, the upper case 12 and the lower case 11 are relatively come close to each other so that the circular ring-shaped lower end face 94 of the circular ring-shaped protruded part 91 (circular ring-shaped end face portion which is located on the outer peripheral side with respect to the upper side liquid flow passage 31*b* and the upper side blocking part 32*b*) is abutted with the circular ring-shaped end face 68*a* of the circular ring-shaped stepped part 68 of the lower case 11. In this case, the circular outer peripheral face 96*b* of the radial direction protruded part 96 of the upper case 12 is abutted with the circular inner peripheral face 68*b* of the circular ring-shaped stepped part 68 of the lower case 11 and thus the upper case 12 is positioned in the radial direction by the lower case 11. Further, the O-ring 26 is crushed in the radial direction between the circular outer peripheral face 95 of the circular ring-shaped protruded part 91 of the upper case 12 and the circular inner peripheral face 68*b* in the radial direction of the lower case 11 in a sandwiched state between the circular ring-shaped end face 96*a* of the radial direction protruded part 96 and the circular ring-shaped end face 68*a* of the circular ring-shaped stepped part 68. As a result, the leakage of liquid from the partitioned chamber 20 is prevented.

When the upper case 12 is superposed on the lower case 11 to form the pump chamber 25 (partitioned chamber 20) in a partitioned state, the lower end of the support shaft 24 penetrated through the bearing part 41 of the rotor 23 is inserted and fixed to the support shaft fixing recessed part 60 of the lower case 11 and the support shaft 24 and the center protruded part 80 are set to be in a coaxial state. Therefore, the stator 29 and the rotor 23 are coaxially disposed with each other and the salient poles 51 of the stator core 28 around which the drive coil 27 is wound face the drive magnet 22 of the rotor 23 disposed in the partitioned chamber 20 through the cylindrical tube part 89 of the upper case 12. In this embodiment, as shown in FIGS. 2(*a*) and 2(*b*), one or plural washers 43 are fitted between the upper end face of the bearing part 41 of the rotor 23 and the bottom part 81 of the protruded part and thereby the magnetic center position in the axial line "L" direction of the drive magnet 22 mounted on the rotor 23 is shifted to a lower side with respect to the magnetic center position in the axial line "L" direction of the stator core 28. As a result, the rotor 23 is urged upward by a magnetic attraction force acted between the stator core 28 and the drive magnet 22.

After that, the upper case 12 and the lower case 11 are fixed to each other by three headed screws which penetrate through the first through third through holes 70(1) through 70(3) provided in the lower case 11 and are threadedly engaged with the first through third screw holes 98(1) through 98(3) provided in the upper case 12. In a state that the pump chamber 25 is partitioned, as shown in FIG. 1(*b*), a gap space "G3" is formed between the tip end part of the turning preventing protruded part 97, which is fitted to the turning prevention recessed part 69, and the bottom face 69*a* of the turning prevention recessed part 69.

(Operation and Effect)

According to this embodiment, when the pump chamber 25 is to be partitioned by inserting the circular ring-shaped protruded part 91 of the upper case 12 into the circular ring-shaped stepped part 68 of the lower case 11, the upper case 12 and the lower case 11 are prevented from being relatively turned to each other around the axial line "L" by the turning prevention mechanism 13. Therefore, the O-ring 26 which is mounted on the circular outer peripheral face 95 of the circular ring-shaped protruded part 91 and is pressurized in the radial direction between the circular outer peripheral face 95 of the circular ring-shaped protruded part 91 and the circular inner peripheral face 68*b* of the circular ring-shaped stepped part 68 is prevented from being twisted in the circumferential direction when the pump case 2 is to be assembled. When the O-ring 26 is twisted in the circumferential direction in a pressurized state in the radial direction, damage may be occurred. However, according to the embodiment of the present invention, the O-ring 26 is prevented from being twisted in the circumferential direction and thus the damage of the O-ring 26 is prevented or reduced.

Further, according to this embodiment, the turning prevention mechanism 13 is structured of the turning preventing protruded part 97 and the turning prevention recessed part 69 and thus its structure is simple. In addition, since the turning prevention mechanism 13 for preventing relative turning is structured by utilizing engagement of the turning preventing protruded part 97 with the turning prevention recessed part 69, for example, in a case that malfunction is occurred in the pump device 1 and thus the pump case 2 is required to be disassembled into two members for finding out a cause of the malfunction, even when the pump case 2 is disassembled, the lower case 11 and the upper case 12 are prevented from being relatively turned to each other. Therefore, the damage of the O-ring 26 is prevented or reduced at the time of disassembling of the pump device 1.

Next, in this embodiment, the turning prevention recessed part 69 is cut out from the outer peripheral side and is provided on the outer side face of the side wall part 62. Therefore, when a flat tip screwdriver or the like is inserted into the gap space "G3" between the tip end part of the turning preventing protruded part 97 fitted to the turning prevention recessed part 69 and the bottom face of the turning prevention recessed part 69 from the outer side of the pump case 2 and, after that, a force is applied in a direction separating the tip end part of the turning preventing protruded part 97 from the bottom face of the turning prevention recessed part 69, the pump case 2 is disassembled into the upper case 12 and the lower case 11.

Further, in this embodiment, the upper case 12 and the lower case 11 are positioned in the axial line "L" direction by abutting the circular ring-shaped lower end face 94 of the circular ring-shaped protruded part 91 with the circular ring-shaped end face 68*a* of the circular ring-shaped stepped part 68. In addition, the upper case 12 and the lower case 11 are positioned in the radial direction by abutting the circular outer peripheral face 96*b* of the radial direction protruded part 96 with the circular inner peripheral face 68*b* of the circular ring-shaped stepped part 68. Further, since the circular outer peripheral face 96*b* of the radial direction protruded part 96 and the circular inner peripheral face 68*b* of the circular ring-shaped stepped part 68 are abutted with each other, a distance between the circular outer peripheral face 95 of the circular ring-shaped protruded part 91 and the circular inner peripheral face 68*b* of the circular ring-shaped stepped part 68, between which the O-ring 26 is mounted, is determined in a predetermined dimension at every position in the circumferential direction and thus the O-ring 26 is uniformly crushed in the radial direction. Therefore, sealing performance by the O-ring 26 is improved. Further, in a case that the circular ring-shaped protruded part 91 is to be inserted into the circular ring-shaped stepped part 68, even when the O-ring 26 mounted on the circular ring-shaped protruded part 91 is moved in the axial line "L" direction, the movement of the O-ring 26 is prevented by the radial direction protruded part 96. Therefore, the O-ring 26 is not sandwiched in the axial line "L" direction between the upper case 12 and the lower case 11 at a displaced position and thus the damage of the O-ring 26 is restrained.

In addition, in this embodiment, the upper case 12 and the lower case 11 are fixed to each other by using headed screws extending in the axial line "L" direction and thus they can be easily disassembled. Further, the upper case 12 and the lower case 11 are positioned in the axial line "L" direction by abutting the circular ring-shaped lower end face 94 of the circular ring-shaped protruded part 91 with the circular ring-shaped end face 68*a* of the circular ring-shaped stepped part 68. Therefore, even when a headed screw extending in the axial line "L" direction is tightened, the O-ring 26 is not damaged by tightening and pressurizing of the headed screw.

Further, in this example, the planar shapes of the upper case 12 and the lower case 11 when viewed in the axial line "L" direction are rectangular and the turning prevention mechanism 13 is structured at the corner portion 2*f* of the upper case 12 and the lower case 11. In this embodiment, the corner portion 2*f* is a portion as a dead space with respect to the circular ring-shaped protruded part 91 in the rectangular upper case 12 and is a portion as a dead space with respect to the circular ring-shaped stepped part 68 in the rectangular lower case 11. In other words, in this embodiment, the turning prevention mechanism 13 is structured by utilizing the dead space and thus increase of the size in the radial direction of the pump case 2 is restrained.

Further, in this embodiment, the stator 29 provided with the drive coil 27 and the stator core 28 is fixed to the upper case 12 on an opposite side to the pump chamber 25 and is sealed by the potting agent 16 as a sealing agent. Therefore, when the pump case 2 is disassembled, liquid such as water which is remained in the pump chamber 25 is prevented from touching electrical conductive parts such as the drive coil 27, the base plate 30 and joined parts of the lead wires 5 with the base plate 30. Further, the lead wires 5 are longer than the suction pipe 3 and the discharge pipe 4 and thus, when the pump case 2 is disassembled, liquid such as water which is remained in the pump chamber 25 is prevented from touching the connector 7 which is attached to the tip ends of the lead wires 5.

OTHER EMBODIMENTS

In the embodiment described above, the tip end face 97*a* of the turning preventing protruded part 97 is located at the same position as the circular ring-shaped lower end face 94 of the circular ring-shaped protruded part 91 in the axial line "L" direction. However, the tip end face 97*a* of the turning preventing protruded part 97 may be formed so as to be located on a side of the lower case 11 with respect to the circular ring-shaped lower end face 94 in the axial line "L" direction. In this case, the turning preventing protruded part 97 is fitted to the turning prevention recessed part 69 before the circular ring-shaped protruded part 91 of the upper case 12 is inserted into the circular ring-shaped stepped part 68 of the lower case 11 and thus relative turning of the upper case 12 to the lower case 11 is prevented surely. Further, when there is a margin in the dimension in the axial direction, the tip end face 97*a* of the turning preventing protruded part 97 may be formed so as to be located on a side of the upper case 12 with respect to the circular ring-shaped lower end face 94 of the circular ring-shaped protruded part 91 in the axial line "L" direction. In other words, it is sufficient that, when the O-ring 26 is crushed in the radial direction, the turning preventing protruded part 97 is prevented from being turned by the turning prevention recessed part 69.

Further, in the embodiment described above, the turning prevention recessed part 69 is structured so as to be cut out. However, instead of providing the cut-out portion, an opening part may be formed in the lower case 11 where the turning prevention recessed part 69 is formed so that a gap space between the tip end part of the turning preventing protruded part 97 inserted into the turning prevention recessed part 69 and the bottom face of the turning prevention recessed part 69 is visible from the outer side. Also in this case, when a flat tip screwdriver is inserted into the gap space through the opening part and a force is applied in a direction so that the tip end part of the turning preventing protruded part 97 and the bottom face of the turning prevention recessed part 69 are separated from each other, the lower case 11 and the upper case 12 can be disassembled.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A pump device comprising:

a first case provided with a circular ring-shaped protruded part;

a second case which is provided with a circular ring-shaped stepped part into which the circular ring-shaped protruded part is coaxially inserted and which partitions a pump chamber on an inner peripheral side of the circular ring-shaped stepped part together with the first case;

an O-ring which is mounted on a circular outer peripheral face of the circular ring-shaped protruded part and is crushed between the circular outer peripheral face of the circular ring-shaped protruded part and a circular inner peripheral face of the circular ring-shaped stepped part in a direction perpendicular to an axial line of the circular ring-shaped protruded part;

a turning preventing protruded part which is provided in the first case and is extended to the second case; and a recessed part which is provided in the second case so that the turning preventing protruded part fits into the recessed part in an axial direction;

wherein the turning preventing protruded part is located at a position separated to an outer side from the circular ring-shaped protruded part and the recessed part is at a position separated to an outer side from the circular ring-shaped stepped part so as to be abutted with the turning preventing protruded part in a circumferential direction; and wherein, when the turning preventing protruded part engages the recessed part, an axial distance between a tip end part of the turning preventing protruded part to an upper end face of the second case is greater than or equal to an axial distance between the upper end face of the of the second case to a circular ring-shaped end face of the of the circular ring-shaped stepped part.

2. The pump device according to claim 1, wherein in a state that the pump chamber is partitioned by the first case and the second case, a gap space is formed between the tip end part of the turning preventing protruded part fitted to the recessed part and a bottom face of the recessed part, and an opening part through which the tip end part of the turning preventing protruded part and the gap space are visible from an outer side is formed in the other of the first case and the second case in which the recessed part is formed.

3. The pump device according to claim 1, further comprising:

a rotor provided with a circular ring-shaped impeller and a drive magnet; and a stator which is provided with a drive coil and a stator core around which the drive coil is wound;

wherein the rotor is disposed between the first case and the second case in a state that the impeller is disposed within the pump chamber; and wherein the stator is fixed to the first case on an opposite side to the pump chamber is sealed by a sealing agent.

4. The pump device according to claim 1, wherein the circular ring-shaped protruded part of the first case is provided with a radial direction protruded part in a circular ring shape which protrudes from the circular outer peripheral face of the circular ring-shaped protruded part to an outer side in the radial direction by a predetermined dimension at a separated position in an axial line direction from the circular ring-shaped end face of the circular ring-shaped stepped part;

a circular ring-shaped tip end face of a tip end of the circular ring-shaped protruded part is abutted with the circular ring-shaped end face of the circular ring-shaped stepped part;

a circular outer peripheral face of the radial direction protruded part is abutted with the circular inner peripheral face of the circular ring-shaped stepped part; and the O-ring is disposed between a circular ring-shaped end face of the radial direction protruded part and the circular ring-shaped end face of the circular ring-shaped stepped part which face in the axial line direction.

5. The pump device according to claim 4, wherein the tip end part of the turning preventing protruded part is located at a same position in the axial line direction as the circular ring-shaped tip end face of the tip end of the circular ring-shaped protruded part.

6. The pump device according to claim 4, wherein the first case and the second case are fixed to each other by plural screws extending in the axial line direction.

7. The pump device according to claim 3, wherein the circular ring-shaped protruded part of the first case is provided with a radial direction protruded part in a circular ring shape which protrudes from the circular outer peripheral face of the circular ring-shaped protruded part to an outer side in the radial direction by a predetermined dimension at a separated position in an axial line direction from the circular ring-shaped end face of the circular ring-shaped stepped part;

a circular ring-shaped tip end face of a tip end of the circular ring-shaped protruded part is abutted with the circular ring-shaped end face of the circular ring-shaped stepped part;

a circular outer peripheral face of the radial direction protruded part is abutted with the circular inner peripheral face of the circular ring-shaped stepped part; and the O-ring is disposed between a circular ring-shaped end face of the radial direction protruded part and the circular ring-shaped end face of the circular ring-shaped stepped part which face in the axial line direction.

8. The pump device according to claim 3, wherein the stator core is provided with a ring-shaped part on a center side and a plurality of salient poles protruding from the ring-shaped part to an outer side in a radial direction, the first case is provided with a center protruded part to which the ring-shaped part of the stator core is attached, a cylindrical tube part which is coaxially structured with the center protruded part and is abutted with outer peripheral faces of the salient poles of the stator core, and an inner side ring-shaped part which connects an opening end of the center protruded part and a lower end part of the cylindrical tube part and thereby a stator accommodating room which accommodates the stator is formed, a magnet accommodating space for accommodating the drive magnet in a cylindrical tube shape is formed together with the pump chamber between the first case structured to provide with the cylindrical tube part, the circular ring-shaped protruded part, and an outer side ring-shaped part which connects an upper end part of the cylindrical tube part with an upper end part of the circular ring-shaped protruded part and the second case on an inner peripheral side of the circular ring-shaped stepped part, and outer peripheral faces of the salient poles and an inner peripheral face of the drive magnet face each other through the cylindrical tube part of the first case.

9. The pump device according to claim 8, wherein the second case is provided with a bottom plate part, a side wall part in a ring shape which is stood up and extended upward from an outer peripheral side portion of the bottom plate part, and a circular recessed part which is formed of the bottom plate part and the side wall part, the circular ring-shaped stepped part is formed on an inner peripheral face of an upper side portion of the side wall part, and grooves which are served as a liquid flow passage are formed on the circular ring-shaped tip end face of the circular ring-shaped protruded part and the bottom plate part of the second case at positions on an inner side with respect to the circular ring-shaped stepped part.

10. The pump device according to claim 8, wherein the first case is provided with a frame-shaped outer peripheral wall which protrudes to an upper side along a circumferential edge of the first case, a base plate for supplying an electric current to the drive coil is disposed in a space which is provided on an inner side with respect to the frame-shaped outer peripheral wall so as to cover the stator disposed in the stator accommodating room, and the sealing agent is poured into the stator accommodating room of the first case and the space provided on the inner side of the frame-shaped outer peripheral wall and thereby the stator and the base plate are covered and fixed by the sealing agent.

11. A pump device comprising:

a first case provided with a first protruded part;

a second case which is provided with a stepped part into which the first protruded part is inserted and which partitions a pump chamber on a side of the stepped part together with the first case;

a sealing ring which contacts an outer face of the first protruded part and which is fitted between the outer face of the first protruded part and an inner face of the stepped part in a direction perpendicular to an axial line of the first protruded part;

a turning preventing protruded part which is provided in the first case and is extended to the second case;

a recessed part which is provided in the second case so that the turning preventing protruded part fits into the recessed part in an axial direction;

wherein the turning preventing protruded part is located at a position separated to an outer side from the first protruded part and the recessed part is located at a position separated to an outer side from the stepped part so as to be abutted with the turning preventing protruded part in a circumferential direction; and wherein, when the pump is fully assembled, an axial distance between a tip end part of the turning preventing protruded part to an upper end face of the second case is greater than or equal to an axial distance between the upper end face of the of the second case to a circular ring-shaped end face of the of the circular ring-shaped stepped part.

* * * * *